United States Patent [19]

Russo

[11] 4,435,744

[45] Mar. 6, 1984

[54] EXPLOSION-PROOF FLUORESCENT LIGHT FIXTURE

[75] Inventor: Salvatore V. Russo, Pearland, Tex.

[73] Assignee: Pauluhn Electric Manufacturing Co., Inc., Pearland, Tex.

[21] Appl. No.: 291,259

[22] Filed: Aug. 10, 1981

[51] Int. Cl.[3] ..... F21S 3/00

[52] U.S. Cl. ..... 362/219; 362/224; 362/225; 362/241; 362/249; 362/260; 362/267; 362/390

[58] Field of Search ..... 362/223, 224, 225, 241, 362/249, 260, 341, 362, 390, 219, 267

[56] References Cited

U.S. PATENT DOCUMENTS

| | | | |
|---|---|---|---|
| 2,807,710 | 9/1957 | Williams | 362/223 |
| 3,014,680 | 12/1961 | Steinbach | 362/225 |
| 4,290,096 | 9/1981 | Szpur | 362/223 |

*Primary Examiner*—Donald P. Walsh

*Attorney, Agent, or Firm*—Bard, Groves, Sroufe, Bishop and Berger

[57] ABSTRACT

An explosion-proof fluorescent light fixture for use in hazardous environments, comprising a pair of fluorescent lamps each shielded by a protective globe and electrical contact containing end connectors at the opposed ends of the lamps and globes. The end connectors and globes form integral one-piece self-contained units and, in case of breakage or a globe, the entire unit of globe and end connectors can be easily detached and replaced simply the unloosening or re-fastening of bolts which normally secure the end connectors to the light fixture. The end connectors are provided with detachable end caps enabling a burned-out tube to be withdrawn and replaced.

8 Claims, 8 Drawing Figures

FIG.1
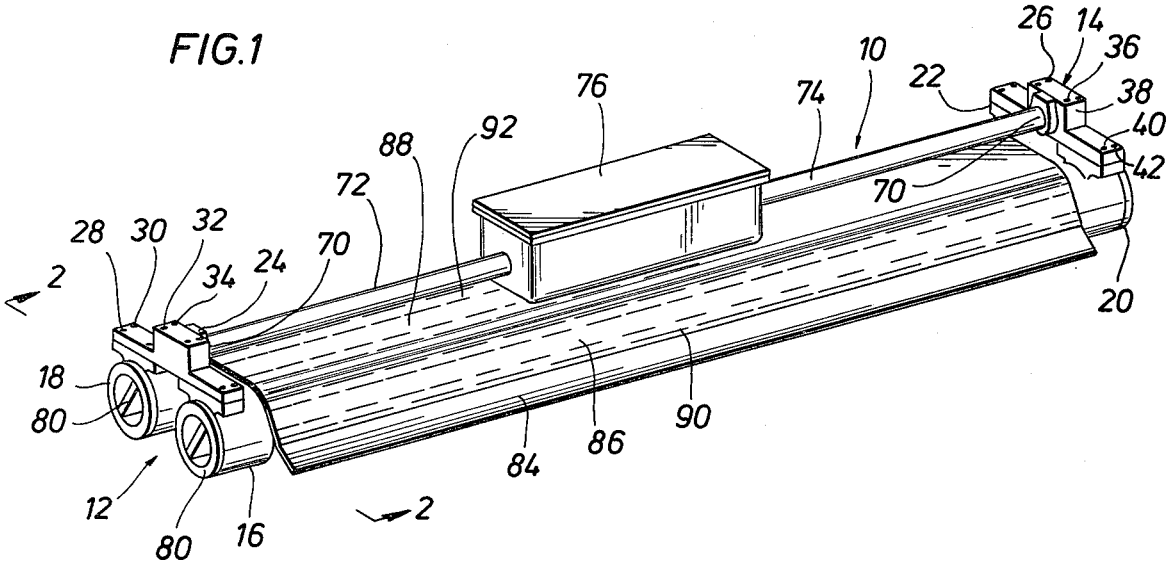
FIG. 2
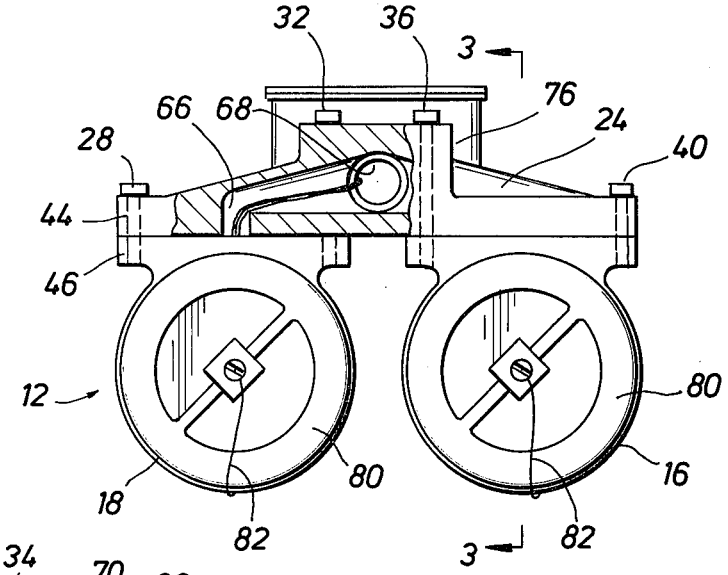
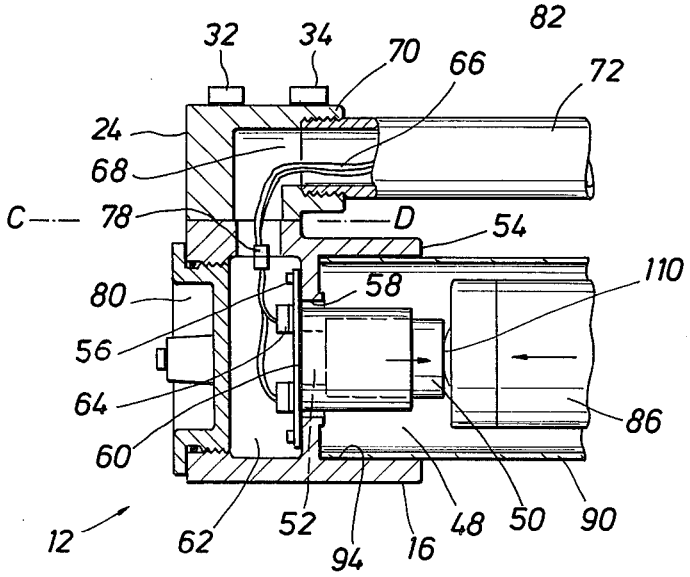
FIG. 3
FIG. 5
(PRIOR ART)
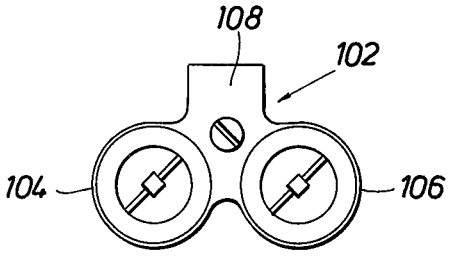

FIG. 1a
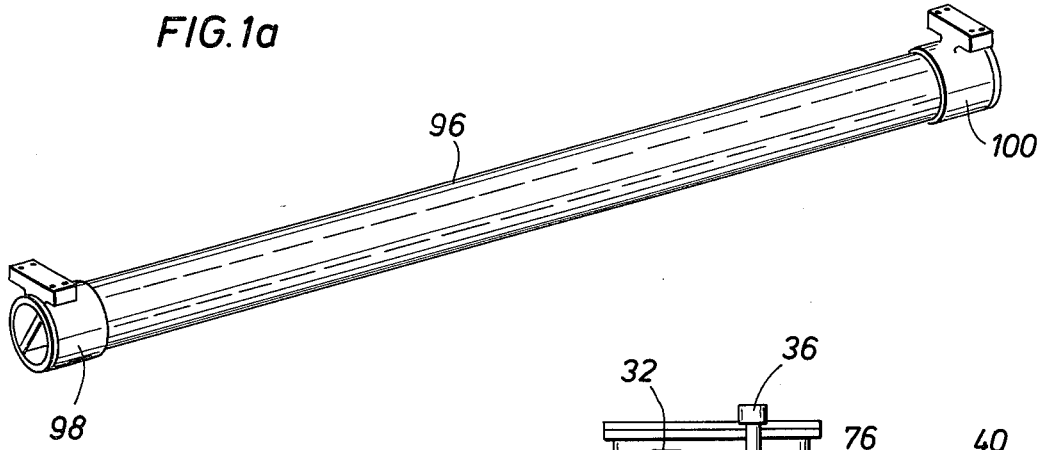
FIG. 2a
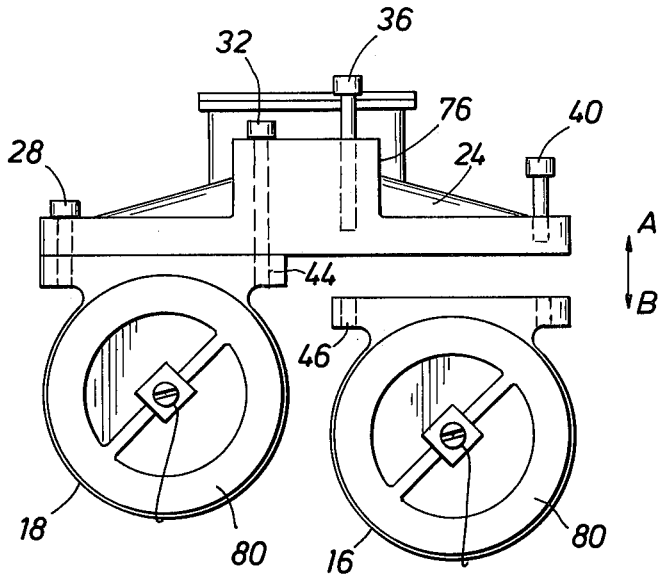
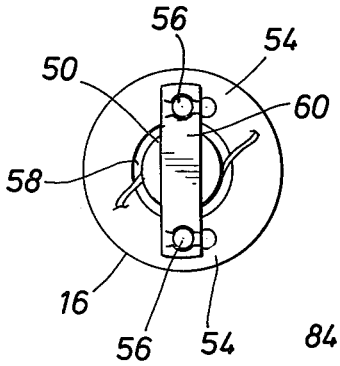
FIG. 3a
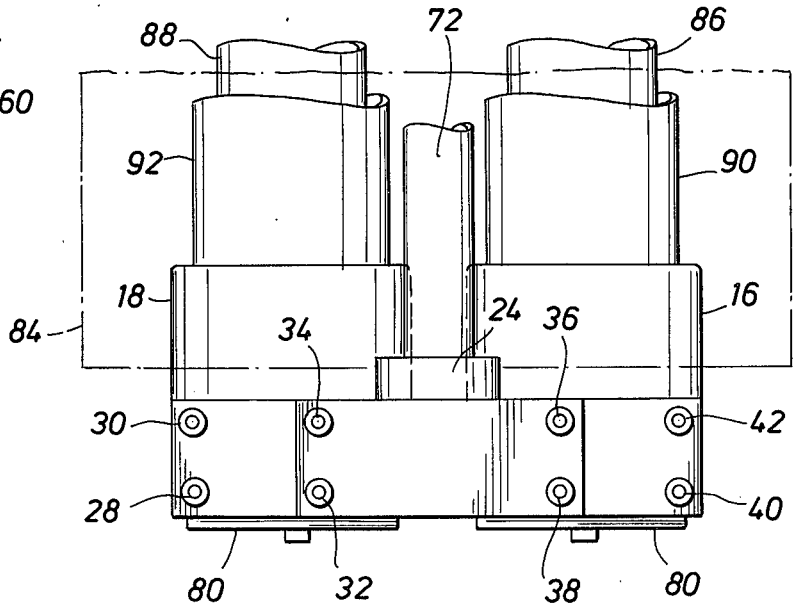
FIG. 4

EXPLOSION-PROOF FLUORESCENT LIGHT FIXTURE

BACKGROUND OF THE INVENTION

The present invention, in general, relates to lighting fixtures and, more particularly, to an explosion-proof fluorescent light fixture for use in hazardous environments.

Already well known in the art are explosion-proof-type lighting fixtures which use one or a plurality of parallel fluorescent lamps and which fixtures, typically, are utilized in hazardous areas and harsh surroundings as, for example, areas having a high gaseous atmosphere such as oil and gas refineries, and are further wisely used on board off-shore drilling rigs, on-shore drilling rigs, on oil-and-gas transport tankers, mines and, in short, in every place where, to one degree or another, flammable and explosive fumes are always present.

It will be appreciated that, for example, in places with high gaseous atmospheres a spark emanating from an insufficiently shielded lamp fixture could set off a considerable explosion that could damage both men and surroundings. Such a spark could be the result of an excessively high pressure build-up within the lamp structure, a wiring deficiency or a short, or the like.

To avoid these type of occurrences, presentday fluorescent lamp fixtures are made substantially explosion-proof. For instance, the end caps of the end connectors which support the lamps and their associated globes, are hermetically sealed in position by threaded sealing elements. In another instance, the globes which protectively surround and enclose the lamps, are sealably seated and fixedly positioned in the end connectors. In case of an excessive build-up of pressure, the latter is released by way of its weakest creeping route, the threaded seals. In structures where the globe ends are rested against inner connector seals, then such seals form a prime route for the release of the excessive pressure. If breakage of the globe should occur, replacement is extremely time consuming, usually causing temporary secession of drilling or mining operations.

Typically, in conventional fluorescent light fixtures, the globes are integrally formed with their associated end pieces or connectors and cannot be individually replaced. In some instances and depending upon the construction of the fixture, the latter has to be totally dismantled in order to repair or replace the globes. In other instances, the entire lamp fixture has to be discarded.

Breakage of a globe is a rather frequent occurrence. Sometimes it is a worker who accidentally hits and breaks the globe, other times it is an object that strikes the globe and demolishes its structure. In all instances, prior art lamp fixtures of the type under discussion employ globes that cannot easily be replaced, if replaceable at all. As a matter of rule, it takes from three to four hours to replace a whole fixture, which in terms of economy is extremely costly, this aside from the inconvenience that is caused by such an event.

Consequently, there is a great need to improve such lighting equipment and develop an explosion-proof fluorescent light fixture which enables the light unit to remain functional and which, in case of globe breakage, enables a easy, effective and, above all, an extremely fast manner of exchanging the damaged component.

SUMMARY OF THE INVENTION

Accordingly, prime object of the invention is to overcome the above-stated disadvantages of the prior art light fixtures and to provide a novel explosion-proof fluorescent light fixture which incorporates a unique and improved mounting system which permits fast and easy replacement of a fluorescent lamp globe.

Another object of the invention is to provide a novel mounting system in which the fluorescent lamp globe and its associated end connector members are fast and easily replaceable as a one-piece completely self-contained unit, the end connector members containing electrical wiring and contact means for the lamp contained within the globe confines.

A still further object of the invention is to provide a fluorescent light fixture of the type under discussion which does not require additional replaceable or repairable components when the necessity arises that a lamp globe has to be replaced.

Yet another object of the invention is to provide a fluorescent light fixture which incorporates a novel globe mounting system, which is fully weatherproof, rugged, durable and high-impact resistant.

Still a further object of the invention is to provide a fluorescent light fixture in which the novel globe mounting and replacement system enables a globe to be mounted or replaced at a minimum expenditure of time and without the light fixture having to be removed from its suspended or mounted position.

Yet another object of the invention is to provide an improved lighting assembly for use in a flammable atmosphere and the like having a support means to be fixedly installed in the gaseous atmosphere and containing at least two spaced apart electrical contact points. Further, this assembly has at least two connector members releasably interconnectable with the support means at one of the spaced apart contact points. A large means is removably positioned between the connector members for receiving electric current from the contact points. A translucent housing member encloses the lamp member and fixedly interconnects the connecting members to form a unitary structure removably coupled to the support member of the lighting assembly.

According to the invention, such a novel explosion-proof fluorescent light fixture comprises one or a pair of translucent housing members herein referred to as globes, extending in spaced-apart parallel relation and each protectively enclosing a fluorescent lamp, both the globes and lamps having opposite ends supported in end connector members. The ends of the globes being integrally formed with the end connector members and forming a one-piece self-contained unit with such connector members, the latter including electrical wiring and contact means for the lamps contained in each globe. A bridge or yoke interconnects each two adjacent connector members at the opposed ends of the globes and lamps. Each globe and its associated end connector members can be replaced or mounted in position by loosening or fastening a plurality of bolts, the latter interconnecting the connector members with their associated bridges or yokes. The connector members each having means to withdraw a burned-out lamp from the globes.

Other and more specific objects will be apparent from the features, elements, combinations and operating procedures disclosed in the following detailed description and shown in the drawings, in which:

BRIEF DESCRIPTION OF THE DRAWINGS

FIG. 1 is an overall axonometric view of the explosion-proof fluorescent light fixture made in accordance with the present invention, illustrating the globes as positioned on the fixture frame;

FIG. 1*a* is a axonometric view of a one-piece, self-contained unit comprised of a globe and its associated end connector elements formed integrally with the globe;

FIG. 2 is a cross-sectional view taken on line 2—2 in FIG. 1, part being broken away to show the electrical wire passages formed in the end connector elements and connecting yoke interconnecting the adjacent connector elements;

FIG. 2*a* is a view similar to FIG. 2, illustrating, however, the manner of dislodgement of one of the connector elements from the yoke;

FIG. 3 is a fragmentary side cross-sectional view taken on the line 3—3 in FIG. 2, illustrating, in detail, the manner in which the globe is formed integrally with an end connector element, and showing the electrical contact arrangement for the fluorescent lamp contained in the globe;

FIG. 3*a* is a fragmentary bottom plan view of the retaining members for holding the electrical contact arrangement of FIG. 3 in position in the end connector element;

FIG. 4 is a fragmentary top end plan view of the arrangement of FIG. 1, illustrating the respective positionings of the globes and lamps with respect to the fixture; and FIG. 5 is an end elevational view of a prior art fluorescent lamp fixture.

DETAILED DESCRIPTION

Referring now to the drawings in which like reference numerals index like parts, and with attention initially directed to FIGS. 1, 2, 3 and 4, there is shown an explosion-proof fluorescent light fixture embodied in accordance with the invention and referenced generally by the numeral 10.

As best shown in FIG. 1, the light fixture 10 is comprised of space-apart ends 12, 14, each including an pair of end supports 16, 18, and 20, 22, respectively, disposed in side-by-side and spaced relation in FIG. 2. The end supports 16, 18, are interconnected by a yoke-shaped connecting member 24 while the end supports 20, 22, are interconnected by an identically-shaped connecting member 26, the connecting members 24, 26, will hereinafter be referred to as the yokes 24, 26. As best illustrated in the arrangement of FIG. 1, the yokes 24, 26, each are detachably secured to the end supports 16, 18, and 20, 22, respectively by means of bolts 28 through 34 for end supports 18 and 22, and bolts 36-42 for end supports 16 and 20. Unloosening and unfastening of these bolts results in detachment of end supports 16, 18, and 20, 22, from the yokes 24, 26, when desired. As shown, for illustration purposes only, the end support 16 in the illustration of FIG. 2*a*, has been detached from the yoke 24 by removal or unfastening of bolts 36, 38, 40 and 42, (only bolts 36 and 40 are shown herein as being removed). In similar fashion, and not shown, yoke 26 can be detached from end support 20 by removal of bolts 36–42 at the opposite end of the fixture 10. Conversely, in order to re-attach the end supports 16 and 20 to the yokes 24 and 26, all that is necessary is to realign the yokes relative to the supports and fasten the respective screws or bolts. As is best shown in FIGS. 2 and 2*a*, both the yokes and end supports are formed with threaded bolt-receiving passages as, for instance, those shown at 44 and 46 FIGS. 2 and 2*a*, in the yokes and end supports, respectively. As regards detachment and reattachment of end supports 18 and 22 relative to yokes 24 and 26, the procedure and manner of operation is identical to that described with respect to end supports 16 and 20.

Detachably mounted within the interior 48, e.g., one each of the end supports, FIG. 3, is a spring-loaded-type electrical contact 50, FIG. 3, which under the bias of a compression spring 52 is urged axially outwardly from the forward open ends 54 of the end supports 16, 18, and 20, 22. Mounted within the end supports interior 48 is a transverse annular flange 54 against which the contact 50 and spring 52 are seated. Both contact 50 and spring 52 are retained in position in interior 48 by retainer elements 54 which are of the spring clip-type and engagingly hold pin elements 56 of the contact 50 which project through the wall of flange 54, FIG. 3*a*. Bridging the opening 58 in flange 54, is a retaining strip 60, the latter preventing entry of spring 52 or body parts of contact 50 into the compartment 62 rearwards of flange 54. Projecting through opening 58 of flange 54 are two electrical contacts 64 formed at the rear of contact 50. These contacts 64 are arranged to be electrically connected with the wiring system of the fixture 10, as will presently be described.

As can best be seen from FIGS. 2, 2*a* and 3, hollow compartment 62 in end support 16 communicates with wire passages 66 formed within the interiors of yokes 24, 26, e.g., interior 48 in the arranement of FIG. 3. Passages 66 connect the compartments, e.g., compartment 62 of FIG. 3, of each two adjacent end supports, 16, 18 or 20, 22, with a central passage or outlet 68 formed centrally in yokes 24, 26, FIGS. 2 and 2*a*, the outlet 68 extending at substantially an angle of 90° relative to the transverse axis of the end supports. The end portions of the outlets 68 are formed into fittings 70, the latter extending spaced from but co-directionally with the longitudnal orientation of hollow interior 48 of the end supports, FIG. 3.

From the illustration shown in FIG. 1, a pair of wire raceways 72, 74, are threadedly secured in fittings 70. The manner of attachment of the raceways in the fittings is best shown in FIG. 3. Centrally, the raceways 72, 74, interconnect or are secured to a ballast 76 which encloses a terminal block or wiring connectors in its wiring compartment for ease of wiring connections. The electrical wiring system is such that wires are run from the electrical contacts or terminals 64 of the electrical contacts 50 in the end supports 16–22, through the compartments 62, and into the wire channels 66 and, via outlets 68, through the wireways 72 and 74 to ballast 76. In case it is required that a wire connect or disconnect has to be made to either connect or disconnect a certain one of the spring-loaded electrical contacts 50, wire connectors 78 are provided in the rear compartments 62 of the end connectors.

To provide access to the interior of the end connectors 16, 18 or 20, 22, it is first necessary to remove end plates 80 which are threadably positioned in the rear end or sides of compartments 62 of the end connectors. Typically, the end plates or caps 80 are formed with seals (not shown) to airtightly seal the end connector interiors. Once positioned, the caps 80 are held captive by a stainless steel link safety cable 82.

In the preferred embodiment of the invention, the end connectors 16, 18 and 20, 22, the yokes 24, 26, the raceways 72, 74, and ballast 76, all are made of either cast, copper-free aluminum alloy or cast brass or brass alloy. In addition, the fixture 10 is arranged so that the wire raceways 72, 74, on account of their high tensile strength, rigidly reinforced the lamp fixture body longitudinally.

Typically, a reflector 84 is provided and positioned over the fluorescent lamps 86, 88, and globes 90, 92, which protectively enclose the lamps, both the lamps and globes will presently be discussed. The reflector 84 may be of any desired configuration and, in the embodiment shown, is made of a heavy wall copper free sheet aluminum and is in the shape of a controlled parabolic construction to direct light efficiently FIG. 1.

In accordance with the embodiment of the invention, the globes 90, 92, and end supports 16, 20, and 18, 22, respectively, form completely self-contained units in that, as shown for instance in FIG. 3, the extreme end portions or sections 94 of the globes are molded or otherwise permanently bonded to the inner peripheries of the hollow interiors 48 of the end supports. In this manner, the opposite ends 94 of the globes are integrally formed with their respective associated end supports as, for example, globe 96, FIG. 1*a*, with end supports 98 and 100. This unit comprised of a globe and end supports does not require any replaceable or repairable components other than, perhaps, the fluorescent lamp, e.g., lamp 86, FIG. 1*a*, which extends longitudinally and coaxially within the globe. It should be noted that the end supports, e.g., supports 98, 100, FIG. 1, which support the globe, are mounted in the frame structure 10 in the manner hereinbefore described with respect to the arrangement shown in FIG. 1, i.e., by removing either the bolts 28–34 or 36–42 and disengaging either the end supports 16 and 20 or 18 and 22. Therefore, in case of accidental breakage of globe 90, FIG. 1, connected to end supports 16 and 20, bolts 36–42 are unfastened to release end supports 16, 18, from yokes 24 and 26. Upon removal of the latter supports, end supports 98, 100, carrying globe 96, FIG. 1*a*, are placed in position relative to yokes 24, 26, and whereupon the bolts 36–42 are tightened, in the latter condition in which the substitute globe unit is firmly and rigidly secured in the light fixture frame 10. This is accomplished with a minimum expenditure of time as compared with procedures involved in replacing broken protective globes of conventional explosion-proof fluorescent light fixtures as, for instance, the prior art arrangement 102 shown in FIG. 5. In the latter device, the entire frame structure has to be dismantled for it has no means to individually disengage either one of the globes 104 or 106 from the fixture 102. The globe and lamp frame 108 is a one-piece construction as opposed to the invention where the yoke, e.g., yoke 24, FIG. 2*a*, is separable from the lamp and globe supports in the direction of the arrow A-B or along the line C-D, FIG. 3.

Having reference now to FIGS. 1, 3, and 4, the fluorescent lamps 86, 88, are held in position interiorly of the globes 90, 92, and have their electric contact ends (one shown at 110, FIG. 3) extend into electrical contact with the spring-loaded electrical contacts 50 in the end supports 16, 18, 20 and 22. In assembled condition the opposed outer ends of the lamps 86, 88, exert an inwardly directed force onto the normally outwardly biassed contact elements 50. In this manner, the outer contact ends of the lamps form a friction-fit electrical connection with the end support electrical contacts 50. In the event a lamp, e.g., lamp 86, FIG. 3, is burned out, retaining strip 60 is removed to free the opening 58 in end support flange 54. This enables electrical contact 50 to be withdrawn through opening 58 and into compartment 62 of the end support. Thereupon, the lamp 86 can be pulled out from the globe interior and be replaced. It should be noted that the annular opening 58 in the end support flanges 54 has a diameter slightly larger than that of a commercially-available fluorescent lamp to permit insertion and withdrawal of this lamp with respect to the globe interior.

From the foregoing discussion it will be appreciated that the explosion-proof fluorescent lamp fixture of the invention permits fast, unique and easy replacement of a completely self-contained globe and electrical contact unit which obviates the need that an entire lamp fixture frame be overhauled or discarded. Also, from the foregoing it will be noted that the novel lamp fixture of the invention is rugged, durable and high-impact resistant, and capable of sustaining an internal explosion without permitting flame to contact the ambient atmosphere.

While the objects of the invention are efficiently achieved by a preferred embodiment of the invention described in the foregoing specification and illustrated in the accompanying drawings, the invention also includes changes and variations falling within and between the definitions of the following claims.

What is claimed is:

1. An explosion-proof lighting assembly comprising a terminal block and wire raceways for supplying power to a plurality of tubular lamps, first and second yoke members each for being supported to opposite ends of said raceways respectively and having a lower portion including means for supporting a plurality of lamps thereto, said yoke portion defining a first portion for engaging a raceway in explosion-proof sealing relationship and an area for engaging lamp support means in sealing relationship, the interior of each said yoke means comprising a wire channel communicating one said raceway to each portion of said yoke to which one said globe is to be supported, a plurality of end supports, each end support having an upper portion for mating with a yoke and a flange portion for receiving an end of a globe, each globe for surrounding a lamp, and for alignment in axial registration with another end support for receiving an opposite end of the globe said end support comprising a portion rearwardly disposed with respect to the said globe defining a compartment having a first wall including an end cap in releaseable, explosion-proof sealing relationship and in axial registration with said globe and to provide for access into said fixture, electrical connection means for coupling to conductor means in said raceway and for bearing against an end of lamp, said electrical connection means being removeably supported to said flange means and covering an aperture between said compartment and said flange means and in registration with said end cap through which a lamp is removeable when said electrical connection means is removed, said upper portion further having an opening for communicating said compartment with one said wire channel.

2. The assembly according to claim 1 wherein said yoke comprises a vertically disposed surface for mating with a raceway and extending axially therefrom and a horizontally disposed surface for mating with each of said end supports.

3. The assembly according to claim 2 wherein first and second end supports are provided for mating with each said yoke member.

4. The apparatus according to claim 3 wherein each said end support comprises a horizontally disposed flange portion and wherein the opening communicating from said compartment to the wire channel in the yoke is vertically disposed.

5. A system according to claim 4 wherein said end cap is threadably mounted to said end support.

6. The assembly according to claim 5 wherein each end connector is releaseably engaged to said yoke by a plurality of bolts each bolt extending vertically through a bore in said yoke and being received in a bore in said end support.

7. In a lighting assembly including a plurality of elongated cylindrical globes and end supports having a first portion supporting each end of each globe and a second support portion supporting said globe to a yoke member, the improvement wherein each end support comprises a first leg having an annular flange portion for receiving a globe, a second portion defining a compartment rearwardly displaced with respect to said globe, an aperture between said compartment and the portion receiving said globe, the electrical connector means removeably mounted to cover said aperture, end cap means releaseably engaged in said end support to close an axial end service of said compartment and mounted in axial registration with said globe and said connector means, said compartment having formed thereabove a portion for releaseably mounting to the yoke member, said portion for releaseably mounting to the yoke including an opening for communicating said compartment with a wire channel in the yoke member.

8. In an explosion-proof lighting assembly including a yoke portion for mechanical support and providing access to conducting means, the subcombination of first and second end support members each having annular recesses for receiving an end of a right cyclindrical globe, a globe supported in said end caps and support members, means positioned rearwardly with respect to each end of the globe in said support defining a compartment, said compartment being closed at an axial end thereof by a releaseably engaged end cap member in axial registration with the globe closing a wall of the compartment, said compartment further comprising electrical connector means closing an aperture between said compartment and said flange means, and said compartment further comprising means for communicating to a raceway for connecting conductors to said connector means.

* * * * *